US006525753B2

(12) United States Patent
Matsuda

(10) Patent No.: US 6,525,753 B2
(45) Date of Patent: Feb. 25, 2003

(54) IMAGE FORMING APPARATUS HAVING DEVELOPING DEVICE INCLUDING DEVELOPING ROLLERS WITH DIFFERING FLUX DENSITY AND OPTICAL WRITING DEVICE USING XONALITY DATA OF FOUR LEVELS OR LESS

(75) Inventor: Itaru Matsuda, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 09/725,516

(22) Filed: Nov. 30, 2000

(65) Prior Publication Data

US 2001/0002841 A1 Jun. 7, 2001

(30) Foreign Application Priority Data

Dec. 1, 1999 (JP) ..... 11-342523

(51) Int. Cl.[7] ..... B41J 2/385; G03G 15/09; G03G 13/04

(52) U.S. Cl. ..... 347/131; 399/269; 399/277

(58) Field of Search ..... 347/131; 399/282, 399/294, 269, 272, 267, 277

(56) References Cited

U.S. PATENT DOCUMENTS

| | | | | |
|---|---|---|---|---|
| 4,177,757 A | * | 12/1979 | Murakawa et al. | 399/269 |
| 4,843,458 A | * | 6/1989 | Ito | |
| 4,912,511 A | * | 3/1990 | Murasaki | 399/269 |
| 4,924,509 A | * | 5/1990 | Yokomizo | |
| 5,416,568 A | | 5/1995 | Yoshiki et al. | |
| 5,416,571 A | * | 5/1995 | Yamada et al. | 399/269 |
| 5,455,662 A | | 10/1995 | Ichikawa et al. | |
| 5,491,537 A | * | 2/1996 | Suzuki et al. | 399/267 |
| 5,500,719 A | | 3/1996 | Ichikawa et al. | |
| 5,523,533 A | * | 6/1996 | Itoh et al. | 399/272 |
| 5,557,382 A | | 9/1996 | Tatsumi et al. | |
| 5,565,907 A | * | 10/1996 | Wada et al. | |
| 5,627,631 A | | 5/1997 | Ichikawa et al. | |
| 5,765,079 A | | 6/1998 | Yoshiki et al. | |
| 5,794,108 A | | 8/1998 | Yoshizawa et al. | |
| 5,801,745 A | * | 9/1998 | Wada et al. | |
| 5,822,663 A | | 10/1998 | Ichikawa et al. | |
| 5,828,935 A | | 10/1998 | Tatsumi et al. | |
| 5,867,607 A | * | 2/1999 | Shibuya et al. | |
| 5,909,610 A | | 6/1999 | Yoshiki et al. | |
| 5,918,090 A | | 6/1999 | Ichikawa et al. | |
| 5,970,290 A | | 10/1999 | Yoshiki et al. | |
| 5,995,790 A | * | 11/1999 | Takeda | 399/272 X |
| 6,021,217 A | * | 2/2000 | Nakahara | |
| 6,075,963 A | | 6/2000 | Ichikawa et al. | |
| 6,289,195 B1 | | 9/2001 | Ichikawa et al. | |

FOREIGN PATENT DOCUMENTS

| | | | |
|---|---|---|---|
| JP | 58-142358 | * | 8/1983 |
| JP | 5-346737 | * | 12/1993 |
| JP | 9-80919 | * | 3/1997 |
| JP | 09-80919 | * | 3/1997 |
| JP | 9-106188 | * | 4/1997 |
| JP | 10-228179 | * | 8/1998 |
| JP | 2000-71439 | * | 3/2000 |

* cited by examiner

*Primary Examiner*—Susan S. Y. Lee
(74) *Attorney, Agent, or Firm*—Oblon, Spivak, McClelland, Maier & Neustadt, P.C.

(57) ABSTRACT

An image forming apparatus of the present invention includes a developing device including two developing rollers arranged in parallel in a direction in which an image carrier moves each for forming a magnet brush thereon. The magnetic poles of the developing rollers for effecting hand-over of a developer between the rollers are provided with the same polarity. An optical writing device optically writes an image on the image carrier in accordance with tonality data of four levels or less for a single dot. The developing device prevents the developer from moving through a gap between the developing rollers and bringing about irregular image density and background contamination. In addition, the optical writing device successfully obviates ghosts, which are likely to appear when a uniform halftone image including solid portions or bold characters is reproduced.

4 Claims, 9 Drawing Sheets

Fig. 6B

FOLLOWING PIXELS ⟷ PRECEDING PIXELS

| | | | | | |
|---|---|---|---|---|---|
| PRECEDING LINE | A | B | C | D | E |
| CURRENT LINE | | | * | F | G |

Fig. 6C

WEIGHT COEFFICIENTS

| | | | | |
|---|---|---|---|---|
| 1/16 | 2/16 | 4/16 | 2/16 | 1/16 |
| | | 1 | 4/16 | 2/16 |

C
F
n
nbit
FA
41
C+F
n+1
TWO TIMES
B
D
G
n
42
B+D
n+1
n+1
43
B+D+G
n+2
n+1
44
LOW 16 BITS
2(C+F)+
B+D+G
TWO TIMES
n+3
n+3
45
LOW 16 BITS
4(C+F)+
2(B+D+G)+
A+E
1/16
n+4
n
46
n+1
Z
A
E
n
47
A+E
n+1
*

| | | |
|---|---|---|
| 213 | 128 | 43 |

| MULTILEVEL | NUMBER OF BITS | GHOST IMAGE |
|---|---|---|
| 2-LEVEL ERROR SCATTERING | 1 | ○ |
| 3-LEVEL ERROR SCATTERING | 2 | ○ |
| 4-LEVEL ERROR SCATTERING | 2 | ○ |
| 16-LEVEL ERROR SCATTERING | 4 | × |

IMAGE FORMING APPARATUS HAVING DEVELOPING DEVICE INCLUDING DEVELOPING ROLLERS WITH DIFFERING FLUX DENSITY AND OPTICAL WRITING DEVICE USING XONALITY DATA OF FOUR LEVELS OR LESS

BACKGROUND OF THE INVENTION

The present invention relates to a copier, facsimile apparatus or similar image forming apparatus.

It is a common practice with an image forming apparatus to develop a latent image formed on an image carrier with a developing device, which includes a plurality of developing rollers. A magnet brush is formed on each of the developing rollers. Japanese Patent Laid-Open Publication No. 10-228179, for example, discloses an image forming apparatus including a developing device in which two developing rollers are arranged in parallel in a direction in which a photoconductive element or image carrier moves. Magnetic poles that effect the hand-over of a developer from one developing roller to the other developing roller are provided with the same polarity. This is successful to prevent the developer from being conveyed through a gap between the developing rollers without being handed over and rendering image density irregular. Let this occurrence be referred to as the entrained movement of the developer for convenience.

The apparatus taught in the above document is more effective when it is operated at a high-speed, because the entrained movement of the developer is aggravated by an increase in the kinetic energy of the developer. Further, the developer stably deposited on the developing rollers in the form of magnet brushes exert scavenging forces that prevent toner from depositing on and contaminating the background of the photoconductive element.

However, the problem with the magnetic poles of the same polarity is that they are apt to lower the density of a halftone image at portions slightly above solid portions or bold characters included in the image, i.e., apt to cause ghosts to appear in such portions. The ghosts are particularly conspicuous in an analog copier that forms the entire uniform halftone image with a small amount of toner.

More specifically, the developing rollers each are rotated at a high speed than the photoconductive element. The developer deposited on the upstream developing roller in the direction of movement of the photoconductive element loses much toner when developing solid portions and characters included in a latent image, which is formed on the photoconductive element. In this condition, the developer is smoothly transferred from the upstream developing roller to the downstream developing roller without being agitated due a repulsive magnetic field formed by the poles of the same polarity between the two rollers. Although this part of the developer transferred to the downstream developing roller again contributes to development, it develops the more upstream portion of the latent image than on the upstream developing roller. This is because the downstream developing roller also rotates at a higher speed than the photoconductive element. Consequently, part of the developer lowered in toner content due to the development of the solid portions and characters lowers the density of the resulting halftone image, causing ghosts to appear in the halftone image.

SUMMARY OF THE INVENTION

It is therefore an object of the present invention to provide an image forming apparatus capable of obviating irregular image density and background contamination ascribable to the entrained movement of a developer as well as ghosts apt to appear when a uniform halftone image containing solid portions and bold characters is reproduced.

BRIEF DESCRIPTION OF THE DRAWINGS

The above and other objects, features and advantages of the present invention will become more apparent from the following detailed description taken with the accompanying drawings in which:

FIG. 6B is a table showing a relation between errors with respect to lines and pixels output from the error scattering matrix of FIG. 6A, FIG. 6C is a table listing weighting coefficients assigned to the errors of FIG. 6B;

DESCRIPTION OF THE PREFERRED EMBODIMENT

Figure 1:
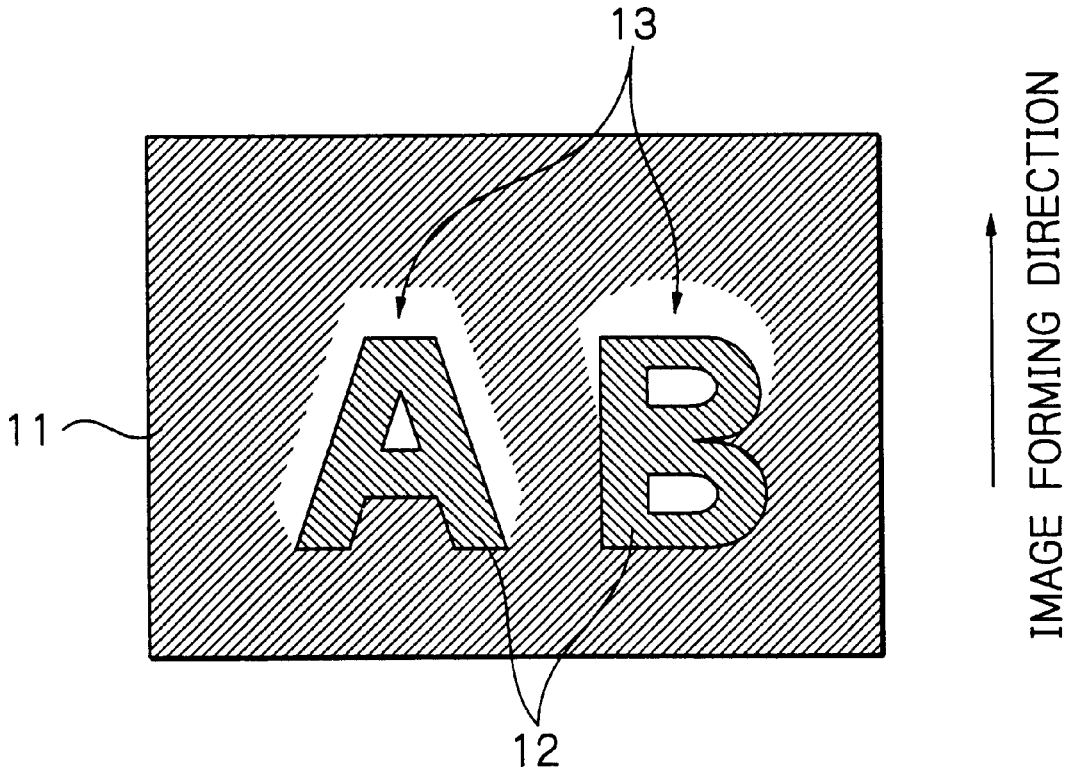
Fig. 1 PRIOR ART
FIG. 1 is a view showing a specific uniform halftone image for describing the problem of a conventional technology.

To better understand the present invention, the problem with the image forming apparatus taught in the previously mentioned Laid-Open Publication No. 10-228179 will be described more specifically with reference to FIG. 1. FIG. 1 shows a specific uniform, halftone image 11 in which solid portions or bold characters 12 exist. In the apparatus taught in the above document, magnetic poles that effect the hand-over of a developer between two developing rollers are provided with the same polarity, as stated earlier. This is apt to lower the density of the halftone image 11 at portions slightly above the solid portions or bold characters 12, i.e., apt to cause ghosts 13 to appear in such portions. The ghosts 13 are particularly conspicuous in an analog copier that forms the entire uniform halftone image with a small amount of toner.

Figure 2:
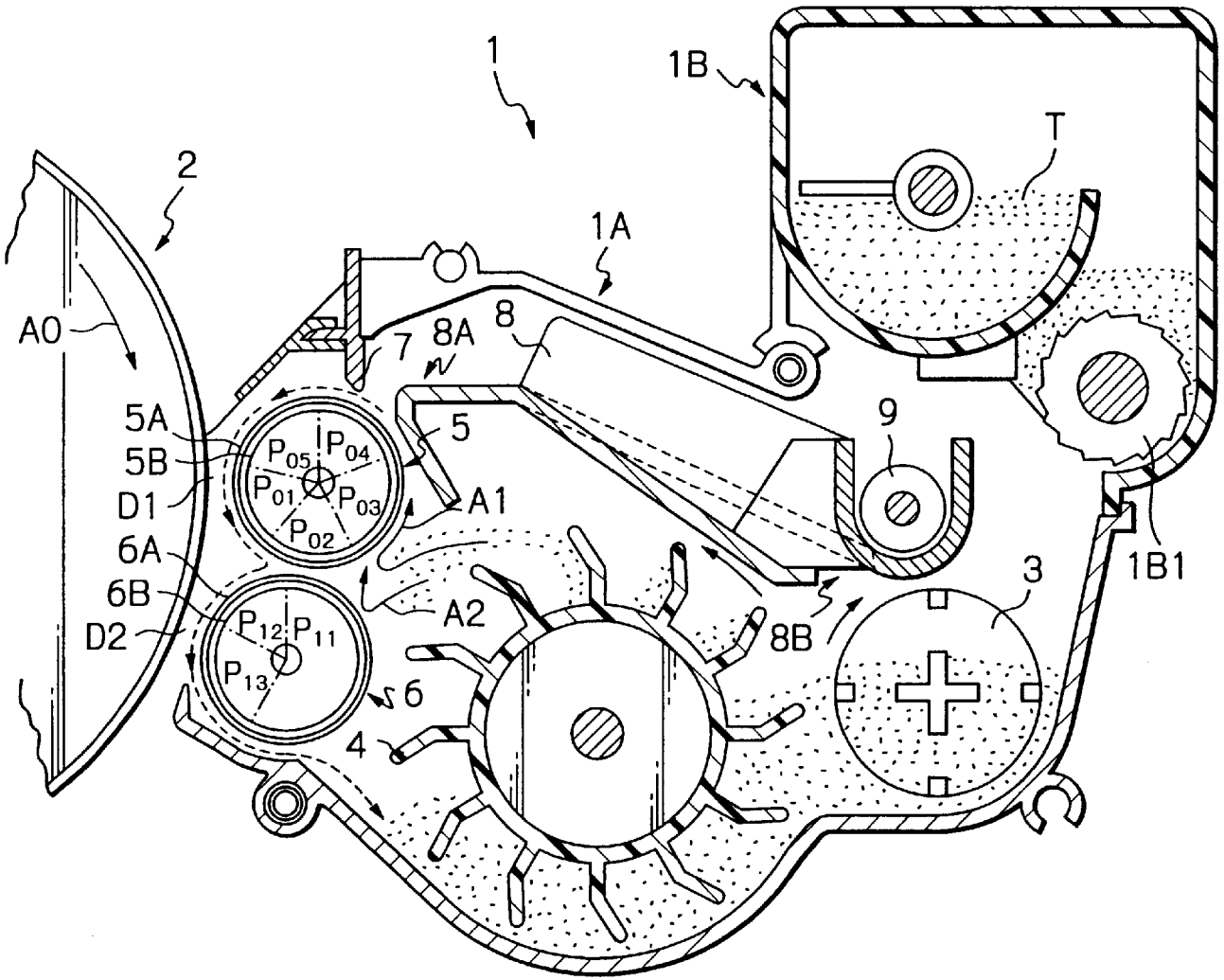
FIG. 2 is a section showing a developing device included in an image forming apparatus embodying the present invention.

Referring to FIG. 2, a developing device, included in an image forming apparatus embodying the present invention, is shown and generally designated by reference numeral 1. As shown, the developing device 1 is generally made up of a developing section 1A and a toner replenishing section 1B. The developing section 1A adjoins a photoconductive element or image carrier 2, which is movable in a direction indicated by an arrow A0 in FIG. 1. In the illustrative embodiment, the photoconductive element 2 is implemented as a drum. The toner replenishing section 1B is mounted on the developing section 1A. While a drive source, not shown, causes the drum 2 to rotate, a charger, not shown, uniformly charges the surface of the drum 2. An optical writing device or exposing means, not shown, exposes the charged surface of the drum 2 imagewise to thereby form a latent image on the drum 2. The developing section 1A develops the latent image and thereby produces a corresponding toner image.

The toner image formed on the drum 2 is transferred to a paper sheet or similar recording medium, not shown, fed from a paper feeder not shown. A fixing unit, not shown, fixes the toner image on the paper sheet. The paper sheet with the fixed toner image, i.e., a printing is driven out of the apparatus. A cleaner, not shown, removes toner left on the drum 2 after the image transfer, and then a discharger, not shown, expels charge left on the drum 2 for thereby preparing the drum 2 for the next image formation. If desired, the toner image may be transferred from the drum 2 to the paper sheet by way of a conventional intermediate image transfer body. Also, the drum 2 may be replaced with a sheet-like photoconductive element. Further, a latent image may be formed on the drum 2 by an electrostatic recording system and then developed by the developing section 1A.

The developing section 1A accommodates an agitator or agitating member 3 implemented as a roller and a paddle wheel 4 therein. A two-ingredient type developer, i.e., a mixture of magnetic or nonmagnetic toner and magnetic carrier is stored in the developing section 1A. The agitator 3 agitates the developer to thereby charge the toner and carrier to opposite polarities to each other by friction. The paddle wheel 4 feeds the developer charged by the agitator 3 to two developing rollers 5 and 6. The developing rollers 5 and 6 adjoin and face the drum 2 and are parallel to each other. A toner feed roller 1B1 is disposed in the toner replenishing section 1B and rotated to feed fresh toner T to the agitator 3.

The developing rollers 5 and 6 include sleeves 5A and 6A, respectively, wherein each of the sleeves 5A and 6A are rotated in a counterclockwise direction, as viewed in FIG. 2, by a respective driveline. Magnetic rollers 5B and 6B are fixed in place within the sleeves 5A and 6A, respectively. The sleeves 5A and 6A are formed of a nonmagnetic material. The magnetic rollers 5B and 6B each have a plurality of magnetic poles sequentially arranged in the circumferential direction thereof.

In the developing section 1A, a doctor blade 7 regulates the thickness of the developer deposited on the upstream developing roller 5, in the direction of rotation of the drum 2, in the form of a layer. A separator 8 adjoins the doctor blade 7 at one end 8A and adjoins the top of the agitator 3 at the other end 8B. A rotatable screw 9 is positioned in the end 8B of the separator 8 and plays the role of a conveyor.

The developer scooped up by the paddle wheel 4 is partly fed to the developing roller 5, as indicated by an arrow A1, and deposited on the roller 5. The rest of the developer scooped up by the paddle wheel 4 hits against the other developing roller 6 and rebounds to deposit on the developing roller 5. While the developing roller 5 in rotation conveys the developer deposited thereon in the form of a layer, the doctor blade 7 regulates the thickness of the layer. When the developer on the developing roller 5 reaches a developing position D1 between the roller 5 and the drum 2, the toner contained in the developer is transferred from the roller 5 to the latent image formed on the drum 2, thereby developing the latent image. As the developing roller 5 further conveys the developer toward the other developing roller 6 away from the above developing position D1, the developer is handed over from the roller 5 to the roller 6 due to the magnetic force of the magnet roller 6B. As a result, the sleeve 6A of the developing roller 6 conveys the developer to a developing position D2 between the roller 6 and the drum 2, as indicated by a dashed arrow. In this manner, the latent image on the drum 2 is developed by the developer on the developing roller 5 at the position D1 and then developed by the developer on the developing roller 6 at the position D2.

After the development at the developing position D2, the developing roller 6 further conveys the developer away from the position D2. At a position where the magnetic force of the magnet roller 6B does not act on the developer, the developer drops to the bottom of the developing section 1A and then moves toward the paddle wheel 4 to be again agitated thereby. The developer scraped off by the doctor blade 7 is guided toward the screw 9 by the separator 8. The screw 9 in rotation conveys the developer and causes it to drop to the agitator 3.

Figure 3:
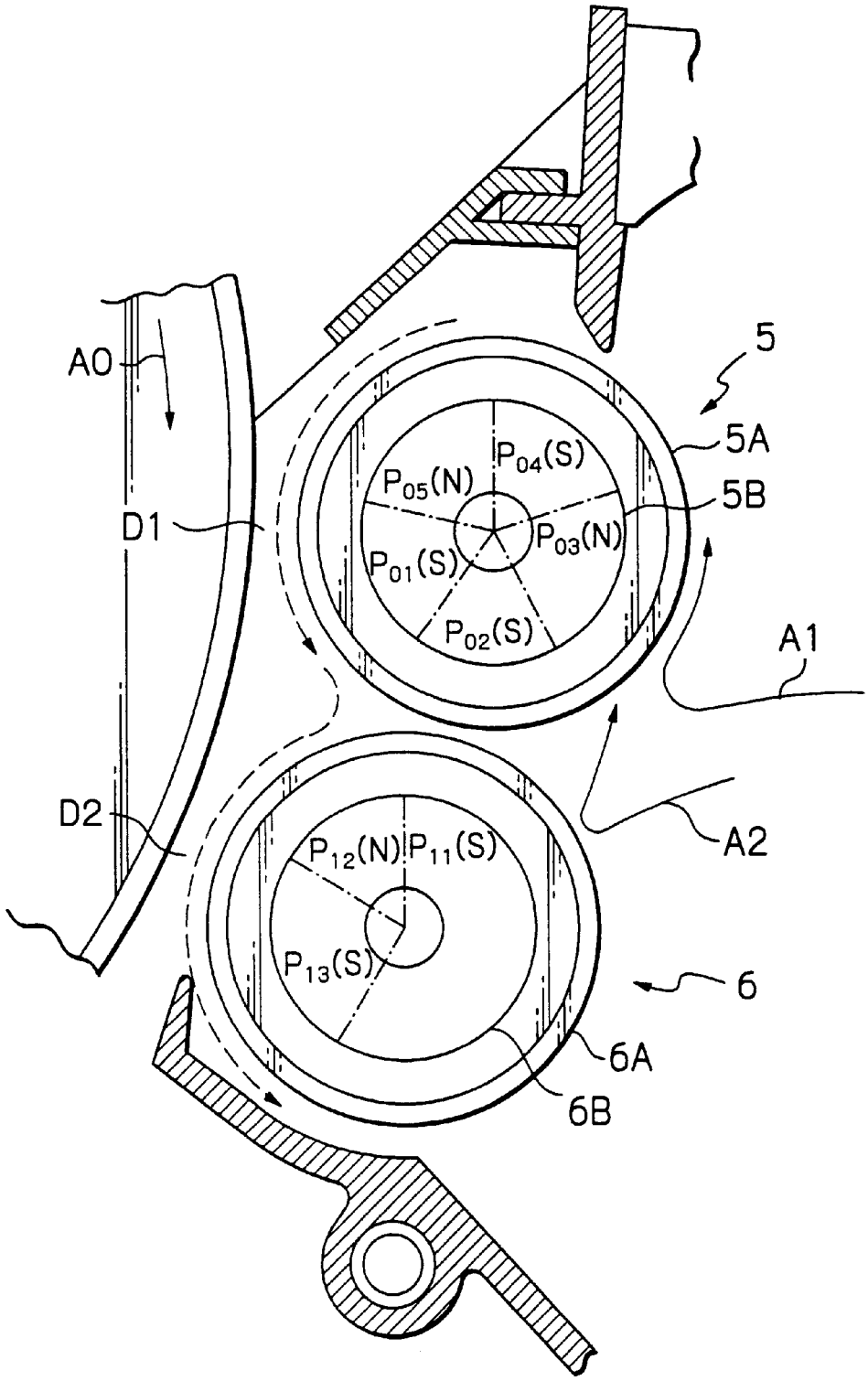
FIG. 3 is a fragmentary enlarged section of the developing device shown in FIG. 2.

FIG. 3 is a fragmentary enlarged view of the developing device 1. As shown in FIGS. 2 and 3, the developing rollers 5 and 6 each have particular magnetic poles whose centers are indicated by dash-and-dot lines. Specifically, the magnet roller 5B has an odd number of poles $P_{01}$ through $P_{05}$ sequentially arranged in the circumferential direction of the roller 5B. Likewise, the magnet roller 6B has an odd number of poles $P_{11}$ through $P_{13}$ sequentially arranged in the circumferential direction of the roller 6B. The poles $P_{02}$, $P_{03}$, $P_{04}$, $P_{05}$, $P_{01}$, $P_{11}$, $P_{12}$ and $P_{13}$ are so arranged as to convey the developer in this order. As shown in FIG. 3, to implement such an order of conveyance, the poles $P_{02}$ through $P_{13}$ except for the poles $P_{01}$, $P_{02}$ and $P_{11}$ which are of the same polarity, are implemented as S poles and N poles alternating with each other, as illustrated.

The poles $P_{01}$, $P_{02}$ and $P_{11}$ of the same polarity are located around a position where the developing rollers 5 and 6 are closest to each other. As for the developing roller 5, the poles $P_{01}$ and $P_{02}$ are positioned upstream of the position where the developing rollers 5 and 6 are closest to each other. In this condition, the poles $P_{01}$, $P_{02}$ and $P_{11}$ form a repulsive magnetic field that serves as a barrier against the developer.

The developer deposited on the developing roller 5 and moved away from the developing position D1 stays at the pole $P_{01}$ for a moment by being obstructed by the above-mentioned repulsive magnetic field or barrier. However, because the developing roller 5 in rotation continuously conveys the successive developer to the pole $P_{01}$, the developer staying at the pole $P_{01}$ is forced out and flies. The pole $P_{11}$ of the developing roller 6, which is closest to the pole $P_{01}$, catches the flying developer and causes it to deposit on the developing roller 6. In this manner, the developer is handed over from the developing roller 5 to the developing roller 6. The repulsive magnetic field surely obviates the entrained movement of the developer deposited on the developing rollers 5 and 6.

The pole $P_{01}$ has a flux density lower than the flux density of the pole $P_{11}$ and 20 mT or above. This successfully protects the developer on the developing roller 5 from the entrained movement even during high-speed operation of the apparatus and thereby obviates irregular image density, as taught in the previously mentioned Laid-Open Publication No. 10-228179 also.

Figure 4:
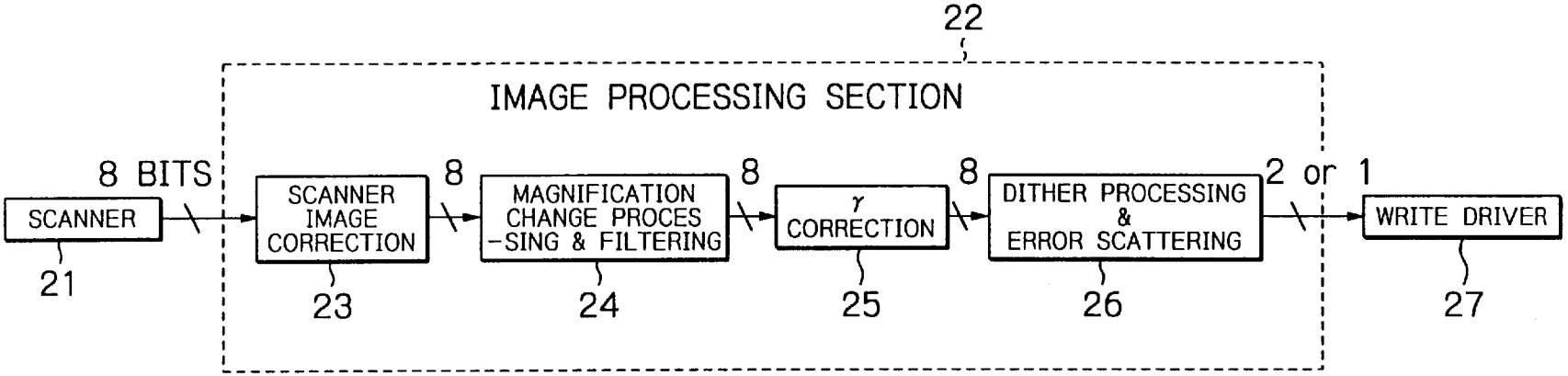
FIG. 4 is a block diagram schematically showing circuitry included in the illustrative embodiment and extending from a scanner to a write driver.

FIG. 4 shows image processing circuitry arranged between a scanner or image inputting means 21 and a write driver 27 included in the illustrative embodiment. As shown, the scanner 21 reads a document image, generates an analog image signal representative of the document image, and converts the analog image signal to an eight-bit digital image signal with an analog-to-digital converter. The digital image signal is input to an image processing section 22 made up of a scanner image correction 23, a magnification processing and filtering 24, a γ correction 25, and a dither processing and error scattering 26. The scanner image correction 23 executes shading correction and other conventional processing with the input digital image signal. The magnification processing and filtering 24 executes magnification processing and filtering with an eight-bit digital image signal output from the scanner image correction 23. The γ correction 25 executes γ correction with an eight-bit digital image signal output from the magnification processing and filtering 24. The dither processing and error scattering 26 executes image processing with an eight-bit digital image signal output from the γ correction 25 by using a dither method and an error scattering method. The dither method and error scattering method transform the eight-bit digital image signal to a one-bit (two-level) or a two-bit (four- or three- level) digital image signal. The write driver 27 drives the optical writing device with the one-bit or two-bit digital image signal output from the dither processing and error scattering 26, so that a latent image is written on the drum 2 in accordance with the digital image signal.

Figure 5:
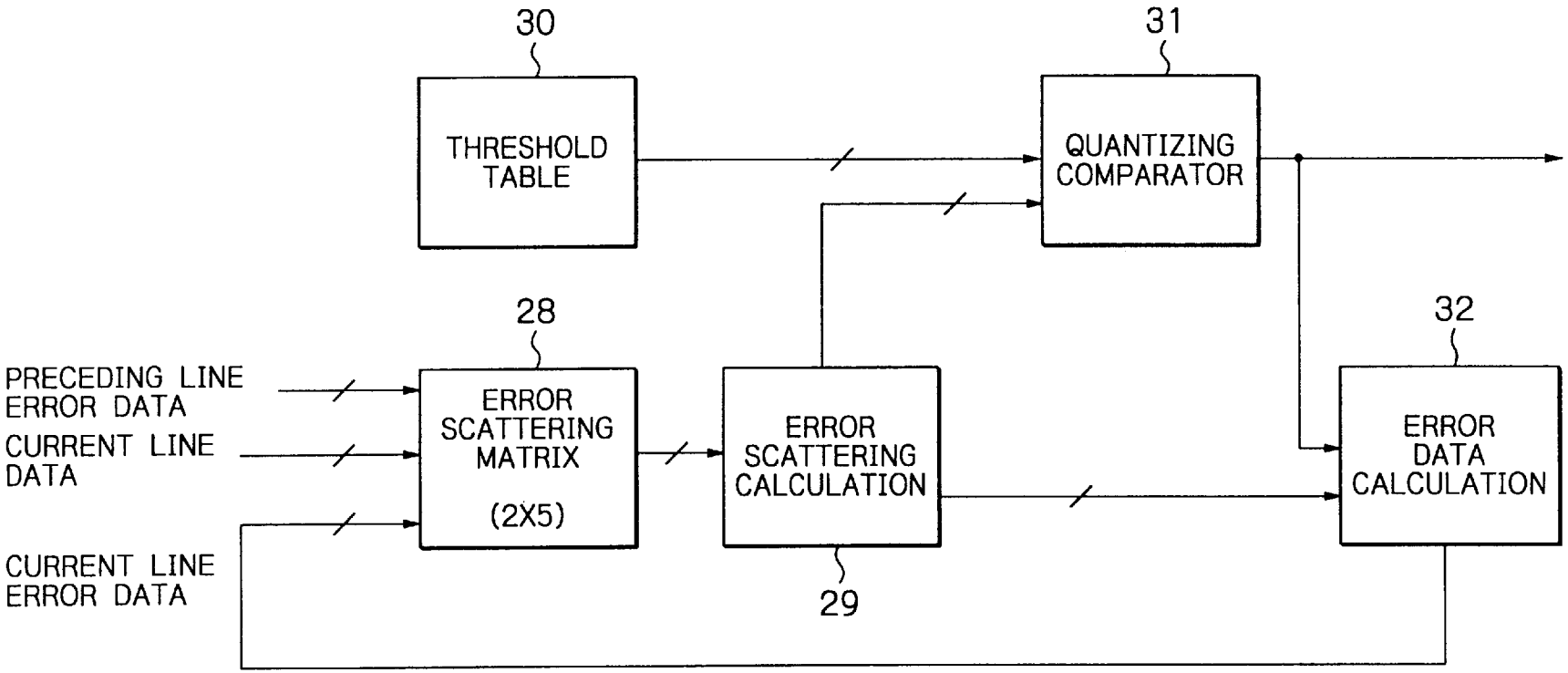
FIG. 5 is a schematic block diagram showing a specific two-level error scattering circuit applicable to a dither processing and error scattering section included in the circuitry of FIG. 4.
Figure 6A:
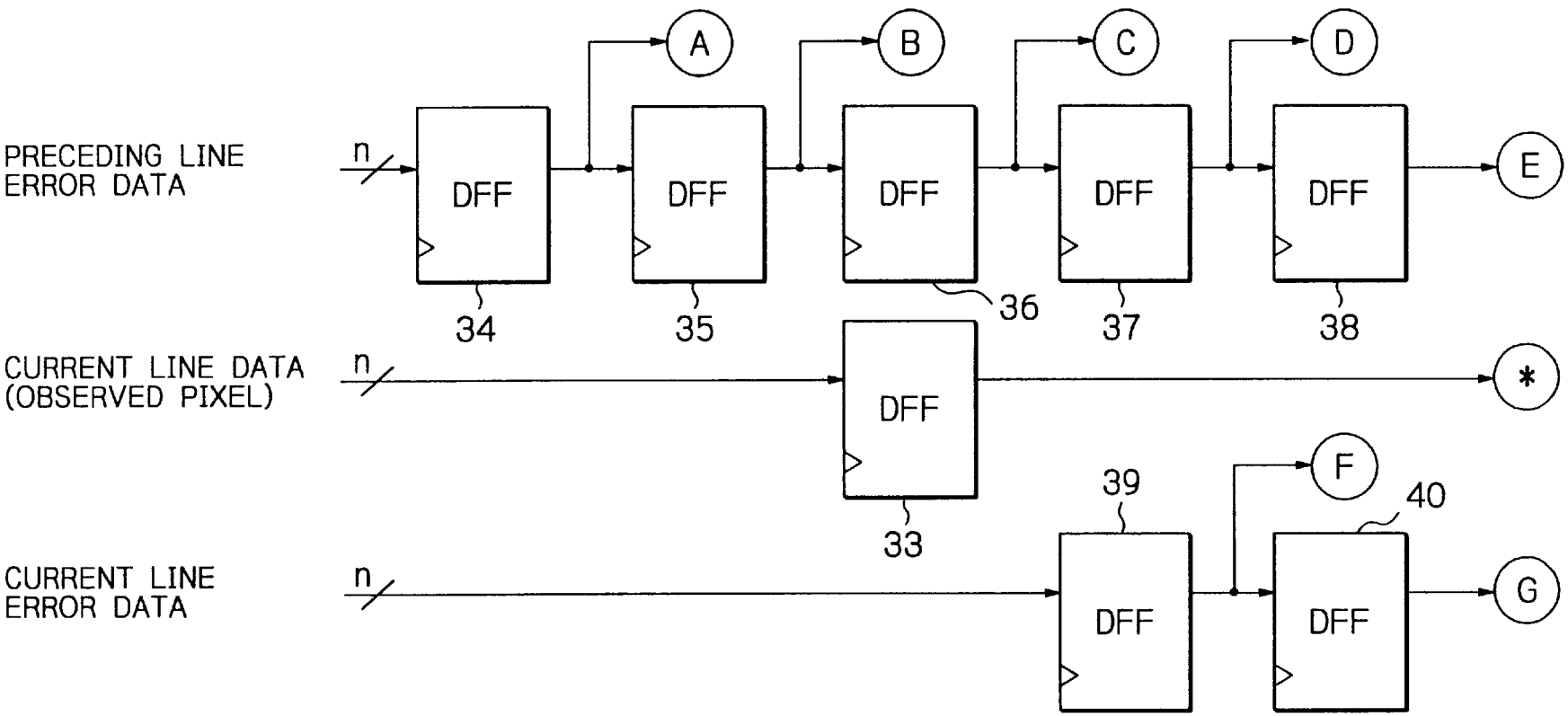
FIG. 6A is a schematic block diagram showing a specific configuration of an error scattering matrix included in the error scattering circuit of FIG. 5.

FIG. 5 shows a specific two-level error scattering circuit applicable to the dither processing and error scattering 26, FIG. 4. As shown, the two-level error scattering circuit includes an error scattering matrix 28 (e.g. 2×5 matrix), an error scattering calculation 29, a threshold table 30, a quantizing comparator 31, and an error data calculation 32. As shown in FIG. 6A, the error scattering matrix 28 includes latches 33 through 40. The latch 33 latches image data having been subjected to dither processing, e.g., data of a pixel on the current line that is being observed (observed pixel hereinafter). The latches 34 through 38 each latch the error data of a pixel one line before an observed pixel on the immediately preceding line and the error data of two pixels preceding and following the above pixel. The latches 39 and 40 each latch one of the data of two pixels following the observed pixel on the current line and fed from the quantizing comparator 31. FIG. 6B shows a relation between errors A through G with respect to the lines and pixels; a symbol * is indicative of the current observed pixel. As shown in FIG. 60, the latches 33 through 40 respectively multiply the data of the pixels assigned thereto by weighting coefficients of 1, 1/16, 2/16, 4/16, 2/16, 1/16, 4/16 and 2/16 to thereby output data * and A through G.

Figure 7:
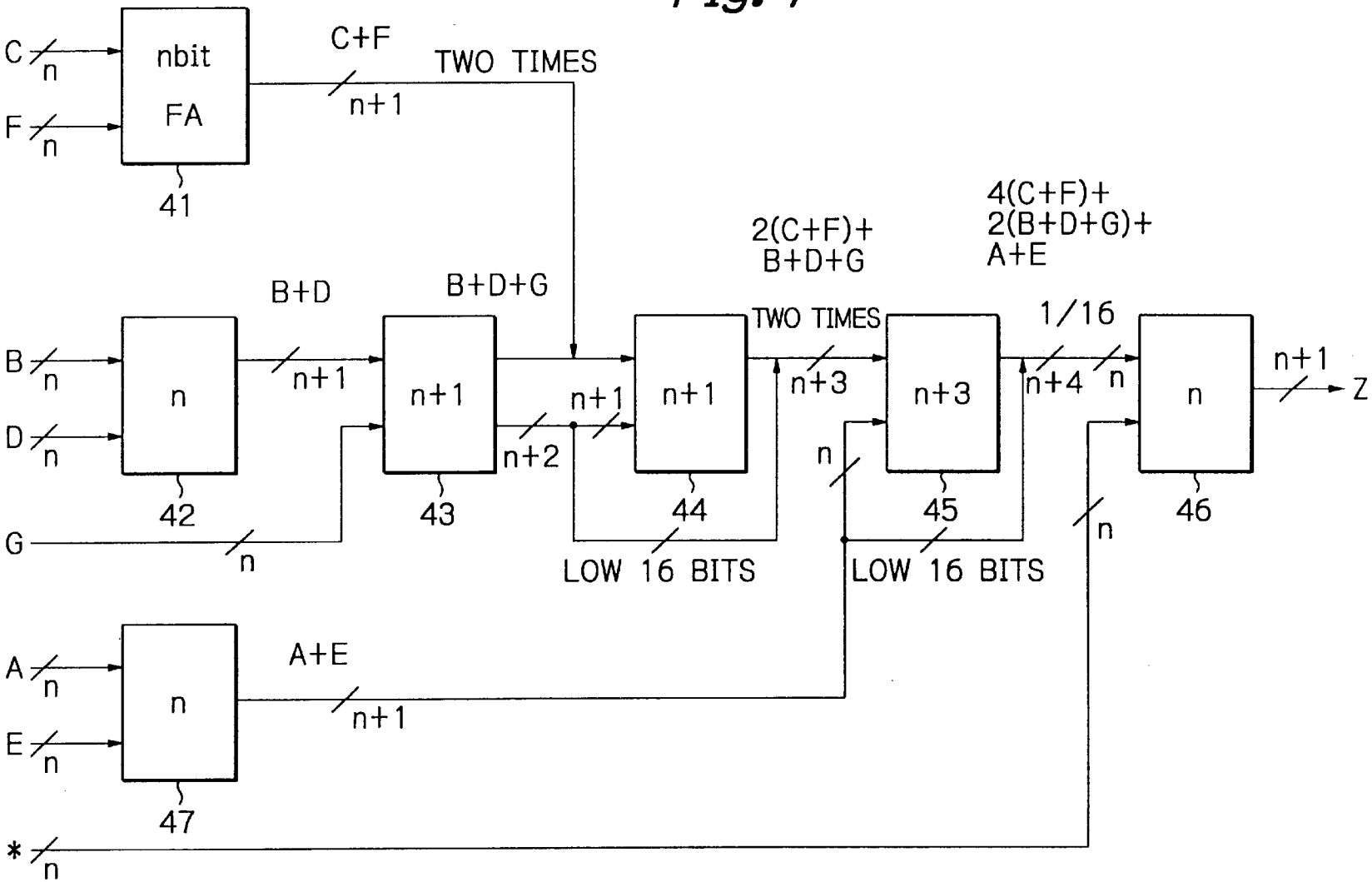
FIG. 7 is a schematic block diagram showing a specific configuration of an error scattering calculating section also included in the error scattering circuit of FIG. 5.

As shown in FIG. 7, the error scattering calculation 29 includes adders 41 through 47; the adder 41 is a full adder (FA). The adders 41 through 47 output a result Z by performing the following calculation with the data * and A through G:

$$Z=*+1/16\cdot(A+2B+4C+2D+E+4F+2G)$$

The quantizing comparator 31 compares the result of calculation Z output from the error scattering calculation 29 with thresholds listed in the threshold table 30. The comparator 31 then binarizes the error-scattered data with a threshold to thereby output one-bit data. Further, the error data calculation 32 calculates, based on the result Z output from the error scattering calculation 29 and data output from the comparator 31, an error to be produced when the data of the observed pixel and subjected to error scattering is binarized. Data representative of this error is input to the error scattering matrix 28.

Figures 8, 9, 10:
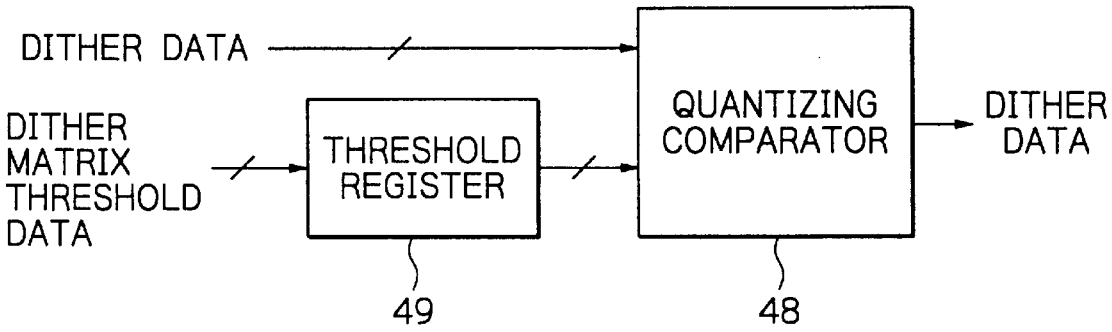
FIG. 8 is a specific table listing three different threshold levels.
FIG. 9 is a schematic block diagram showing a specific dither processing circuit applicable to the dither processing and error scattering section.
FIG. 10 is a table listing experimental results that compare various multiple levels, which may be used for the error scattering of the illustrative embodiment, with respect to the appearance of ghosts in a halftone image.

FIG. 8 shows specific three thresholds 43, 128 and 213 listed in the threshold table 30. Such a threshold table 30 implements four-level error scattering circuitry. In this specific case, the quantizing comparator 31 compares the data input from the error scattering calculation 29 with the three thresholds 43, 128 and 213. The comparator 31 outputs 1 if the input data is between 0 and 43, outputs 2 if it is between 128 and 212, and outputs 3 if it is between 213 and 255. Alternatively, the threshold table 30 may list two thresholds in order to implement three-level error scattering circuitry.

FIG. 9 shows a specific dither processing circuit also applicable to the dither processing and error scattering 26. As shown, the dither processing circuit is made up of a quantizing comparator 48 and a threshold register 49. The threshold register 49 sequentially stores the threshold data (eight-bit thresholds) of the dither matrix. The quantizing comparator 48 compares the image signal (dither data) output from the γ correction 25 with the dither matrix thresholds of the threshold register 49 for thereby quantizing the image signal.

In the illustrative embodiment, the dither processing and error scattering 26 may be implemented by only one of the dither processing circuit and error scattering circuit. When use is made only of the dither processing circuit, the dither processing circuit should output tonality data of four levels or less. For example, in the dither processing circuit shown and described, the threshold register 49 will be replaced with a dither matrix threshold table for binarization. The quantizing comparator 48 will compare the image signal (dither data) output from the γ correction 25 with a dither threshold for binarization listed on the threshold table, thereby transforming the image signal to one-bit (two-level) data.

Further, when the dither processing circuit uses a dither matrix threshold table for four levels as the threshold table, the quantizing comparator 48 outputs two-bit (four-level) data. Likewise, when the dither processing circuit uses a dither matrix threshold table for three levels as the threshold table, the quantizing comparator 48 outputs two-bit (three-level) data.

FIG. 10 compares a two-level, a three-level, a four-level and other error scattering circuits, which may be applied to the dither processing and error scattering 26, with respect to the appearance of ghosts in a halftone image, as determined by experiments. In FIG. 10, a circle and a cross respectively show that ghosts did not appear and that they appeared. As FIG. 10 indicates, ghosts do not appear when the dither processing and error scattering 26 outputs data transformed to tonality data of four levels or less.

Specifically, as the number of levels increases, an image is rendered more in an analog fashion and has tonality thereof more smoothly rendered with a texture particular to error scattering being inconspicuous. However, ghosts and other irregularities in image are apt to be conspicuous. Although four-level error scattering causes at least two kinds of halftone reproduction data to exist, it makes ghosts inconspicuous because a texture pattern structure ascribable to error scattering remains. Two-level error scattering is more advantageous as to ghosts because it renders the texture more conspicuous. Further, as for ghosts, dither processing is advantageous over error scattering because it implements a dot-concentrated pattern.

As stated above, in the illustrative embodiment, the developing device 1 includes two developing rollers 5 and 6 arranged in parallel in the direction in which the photoconductive drum or image carrier 2 moves. The developing roller 5 is positioned upstream of the developing roller 6 in the direction of movement of the drum 2. The magnetic poles $P_{01}$ and $P_{02}$ of the roller 5 and the magnetic pole $P_{11}$ of the roller 6, which effect the hand-over of the developer from the developing roller 5 to the developing roller 6 in cooperation, are of the same polarity. The optical writing device optically writes an image on the drum 2 in accordance with tonality data having four levels or less for a single dot. The developing device can therefore protect the developer from the entrained movement and therefore obviates irregular image density and background contamination. In addition, optical writing using tonality data having four levels or less for a single dot is successful to obviate ghosts, which are likely to appear when a uniform halftone image including solid portions or bold characters is reproduced.

Further, the pole $P_{11}$ of the developing roller 6 has a higher flux density than the poles $P_{01}$ and $P_{02}$ of the developing roller 5. This further promotes the obviation of irregular image density and background contamination as well as ghosts.

Moreover, because the tonality data is subjected to image processing using one or both of the error scattering method and dither method, they render images with higher tonality and free from irregularity. Particularly, data of four levels or less promotes rapid image processing and optical writing because they can be processed in two bits. This advantage is more prominent with a high-speed image forming apparatus because the entrained movement of the developer is more aggravated in such an apparatus.

Various modifications will become possible for those skilled in the art after receiving the teachings of the present disclosure without departing from the scope thereof.

What is claimed is:

1. An image forming apparatus comprising:

a developing device including an upstream roller and a downstream roller arranged in parallel at an upstream side and a downstream side, respectively, in a direction in which an image carrier moves, wherein a magnetic pole of said upstream developing roller and a magnetic pole of said downstream developing roller for effecting hand-over of a developer from said upstream developing roller to said downstream developing roller are provided with a same polarity, and wherein said magnetic pole of said downstream developing roller has a higher flux density than said magnetic pole of said upstream developing roller; and an optical writing device for optically writing an image on said image carrier in accordance with tonality data of four levels or less for a single dot.

2. An apparatus as claimed in claim 1, wherein the tonality data are subjected to image processing using at least one of an error scattering method and a dither method.

3. A method of transferring developer in an image forming apparatus, comprising:

forming a magnetic pole of a given polarity on an upstream developing roller and on a downstream developing roller, wherein said magnetic pole of said downstream developing roller has a higher flux density than said magnetic pole of said upstream developing roller, said upstream developing roller and said downstream developing roller being arranged in parallel at an upstream side and a downstream side, respectively, in a direction in which an image carrier moves; and passing developer from said upstream developing roller to said downstream developing roller.

4. The method of claim 3, further comprising:

optically writing an image on said image carrier in accordance with tonality data of four levels or less for a single dot.

* * * * *

UNITED STATES PATENT AND TRADEMARK OFFICE

CERTIFICATE OF CORRECTION

PATENT NO. : 6,525,753 B2
DATED : February 25, 2003
INVENTOR(S) : Matsuda

It is certified that error appears in the above-identified patent and that said Letters Patent is hereby corrected as shown below:

Title page, Item [54] and Column 1, lines 1-6,
Should read as follows:

-- (54) IMAGE FORMING APPARATUS HAVING DEVELOPING DEVICE INCLUDING DEVELOPING ROLLERS WITH DIFFERING FLUX DENSITY AND OPTICAL WRITING DEVICE USING TONALITY DATA OF FOUR LEVELS OR LESS --

Signed and Sealed this

Eighth Day of July, 2003

JAMES E. ROGAN
*Director of the United States Patent and Trademark Office*